US008637781B2

(12) United States Patent
Derengowski et al.

(10) Patent No.: US 8,637,781 B2
(45) Date of Patent: Jan. 28, 2014

(54) WATER SEALING THE SIDE KEY SYSTEM ON AN ELECTRONIC DEVICE

(75) Inventors: Thomas D. Derengowski, Park Ridge, IL (US); John Delianides, Lake Villa, IL (US); Thomas E. Gitzinger, Libertyville, IL (US)

(73) Assignee: Motorola Mobility LLC, Libertyville, IL (US)

( * ) Notice: Subject to any disclaimer, the term of this patent is extended or adjusted under 35 U.S.C. 154(b) by 295 days.

(21) Appl. No.: 13/282,018

(22) Filed: Oct. 26, 2011

(65) Prior Publication Data

US 2013/0105288 A1 May 2, 2013

(51) Int. Cl.
*H01H 13/06* (2006.01)

(52) U.S. Cl.
USPC ..... 200/302.2; 200/293

(58) Field of Classification Search
USPC ..... 200/302.2, 341, 293, 330, 345
See application file for complete search history.

(56) References Cited

U.S. PATENT DOCUMENTS

| | | | |
|---|---|---|---|
| 4,825,023 | A | 4/1989 | Morse |
| 6,963,039 | B1 | 11/2005 | Weng et al. |
| 2010/0072046 | A1 | 3/2010 | Maeda et al. |
| 2010/0105451 | A1 | 4/2010 | Wedel et al. |
| 2010/0254124 | A1 | 10/2010 | Bayat et al. |

FOREIGN PATENT DOCUMENTS

| | | | |
|---|---|---|---|
| JP | 2009289639 | A | 12/2009 |

*Primary Examiner* — Xuong Chung Trans

(57) ABSTRACT

An improved water sealing side key system for use in electronic device 24, such as but not limited to a mobile phone, and which provides for the construction of the seal assembly 21 as a rigid frame 29 and an elastomeric sealing material that allows for both a compressive and circumferential (perimeter) seal 28 as well as the overall non-binding movement of a side key 20 within the seal and the ability to closely control the thickness, tolerance spacing and tactile feel of the side key 20.

15 Claims, 6 Drawing Sheets

SECTION A-A

WATER SEALING THE SIDE KEY SYSTEM ON AN ELECTRONIC DEVICE

BACKGROUND OF THE INVENTION

1. Field of the Disclosure

The disclosure relates in general to electronic devices, and more particularly, to mobile electronic devices, such as a mobile telephone, with an electronic display and side keys.

2. Background Art

Mobile phones and other electronic devices are very useful for: telephone calls; internet usage; e-mailing; texting; downloading; photography; video conferencing; surfing and searching the world wide web; retrieving, storing and viewing information; social networking; calculating; computing, playing games, etc. Most electronic devices will fail, short out, or otherwise become ineffective or less effective, upon exposure to too much moisture, such as heavy rain, sleet, snow, or from swimming or being submerged in water, such as accidentally dropping the phone in toilets, puddles, swimming pools, basins or sinks Over the years various attempts have been made to seal buttons, keys, and other features of electronic devices. These attempts have met with varying degrees of success. However, most conventional prior sealing designs and systems do not effectively seal and waterproof the side keys of an electronic device.

It is, therefore, desirable to provide an improved water sealing side key system for side keys of an electronic device which overcomes most, if not all, of the preceding problems.

SUMMARY OF THE INVENTION

An improved water sealing side key system effectively seals and waterproofs the side keys of an electronic device. The improved water sealing side key system provides a unique sealing design for the electronic device which is cost-effective, attractive, and effective. The user friendly water sealing side key system is reliable, easy to use, and comfortable. It also provides better tactile feel and touch control.

The improved water sealing side key system can be used with any electronic device that requires a higher level of water ingress protection. The electronic device can be a mobile electronic device, such as: a radiotelephone, a cellular (cell) phone, a mobile phone, smart phone, flip phone, slider phone, android phone, tablet phone, camera phone, clamshell device, portable networking device, qwerty flip device, wireless device, portable gaming device, mobile communications device, personal digital assistant (PDA), wireless e-mail device, a two way pager, internet communication device, android tablet, ipod, ipad, blackberry, tablet device, laptop computer, netbook, personal computer, hand held electronic device, or combinations of any of the preceding.

This water sealing side key system can be used on a single walled housing, but is particularly useful for a dual inner and outer walled housing so that the side keys can be assembled from inside the housing rather than front loaded.

This inventive water sealing side key system is for the water (liquid) sealing of the overall side key system with both a compressive and perimeter gasket seal. Additionally, the inventive water sealing side key system allows the side key switch position to be tightly controlled and tolerated within the device for improved user tactile feel when activating and pressing the key(s).

The inventive water sealing side key system provides for: (A) the construction of the seal as a rigid frame and an elastomeric sealing material that allows for both a compressive and circumferential (perimeter) seal; and (B) the overall non-binding movement of a cosmetic side key within a water seal and the ability to closely control the thickness (space) and tactile feel of the side key.

In one preferred form the inventive water sealing side key system provides the following:

(1) The side key(s) is back loaded from inside the device and retained in the housing by side flanges.

(2) The side key(s) is retained and water sealed by the seal assembly. This seal provides both a compressive face and perimeter water seal against the housing racetrack oval walls.

(3) The side key(s) travel within the sheet metal sidewall of the seal assembly such that the side key(s) doesn't bind on the silicon over mold material.

(4) The seal assembly is pressed into the housing until the sheet metal flats contacts the housing racetrack walls and compresses the silicon material to its prescribed compression. The sheet metal spring fingers lock the seal assembly against the housing and prevent it from backing out.

(5) The side key flex assembly with stiffener presses against the seal assembly and is retained by the housing ribs. The rear walls of the seal assembly provide the tolerance spacing between the side key plunger and the switch for superior tactile feel.

In another preferred form, the side key is a front loaded side key and a composite seal assembly is provided with an elastomeric seal which is water sealed to a sidewall and/or housing. The elastomeric seal con comprise inner and outer portions which are hermetically sealed and molded to each other. The outer portion can have one or more spiked energy directors for ultrasonically welding the elastomeric seal to the sidewall and/or housing.

The inventive water sealing side key system also provides a waterproof design that helps provide a core competency to differentiate cell phone and other electronic products from electronic devices that do not have such unique water sealing side key system.

The need to provide a seal around side keys without negatively affecting the tactility of the switches is important to providing a quality feeling product. The inventive water sealing side key system can provide a back loaded side key design utilizing a secondary piece providing both a water seal and an interface between the switch actuator and the button providing the head of the side key. An insert molded metal frame can provide retention and compressive pressure between the main housing and the silicone over mold.

The water sealing side key system, if desired, can be a front loaded key design with a front loaded side key or can be a back loaded design with a back loaded side key. The side key can have a head, a plunger for engaging a switch and an intermediate portion which can extend between and connect the head to the plunger. The intermediate portion of the front loaded side key can comprise a stem with a diameter or transverse or lateral span that is smaller than the head and plunger. The intermediate portion of the back loaded side key can comprise side flanges providing side flange portions which can be securely retained in the housing. The side flange portions can have a diameter and traverse span that is greater than the head, but smaller than the plunger.

The inventive water sealing side key system design is unique and different from conventional prior art electronic devices.

The inventive water sealing side key system as described in the patent claims hereafter have achieved unexpected surprisingly good results.

A more detailed explanation of the invention is provided in the following detailed descriptions and appended claims taken in conjunction with the accompanying drawings.

DETAILED DESCRIPTION OF THE INVENTION

The following is a detailed description and explanation of the preferred embodiments of the invention and best modes for practicing the invention.

Figure 1:
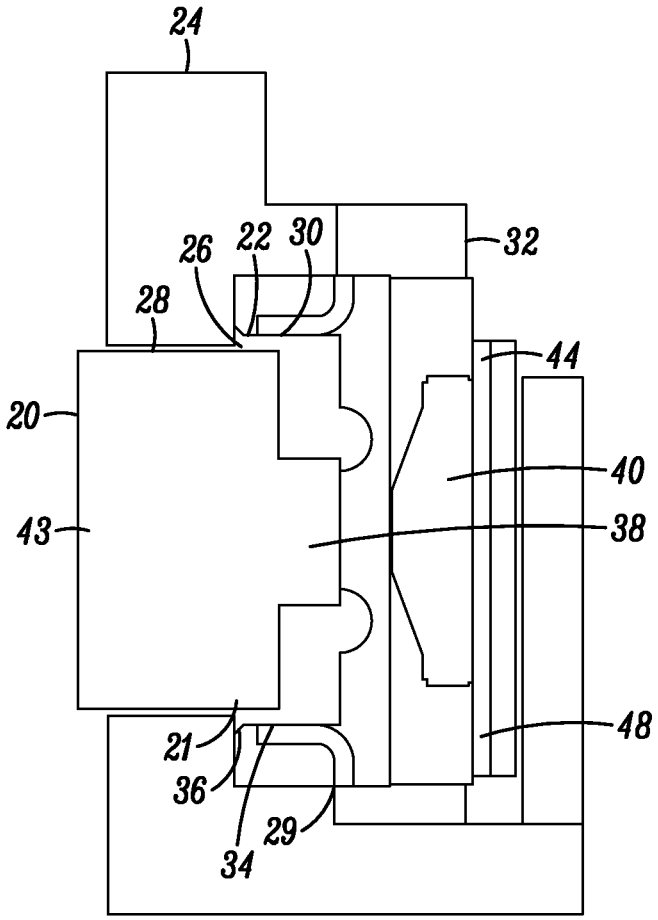
FIG. 1 is a cross-sectional view of a side key retained and sealed by the water sealing side key system of an electronic device in accordance with principle of the present invention.

As shown in the FIG. 1 of the drawings, a moveable side key 20 is retained and water sealed by a composite seal assembly 21 of a water sealing side key system 22 of an electronic device 24. The water sealing side key system provides both a compressive face 26 and a perimeter seal 28 which can provide a perimeter seal portion and elastomeric perimeter gasket seal that can dynamically seal and engage the side key and can be positioned against the racetrack oval walls 30 comprising a sheet metal sidewall providing a rigid frame 29 of the housing 32 such as comprising polycarbonate (PC). The side key travels within the inward portion 34 of the sheet metal sidewall so the side key doesn't bind on the silicone over mold material 36. The seal assembly can control the spacing and tactile feel of the side key. The side key plunger 38 can be closely aligned to a switch 40.

Figure 2:
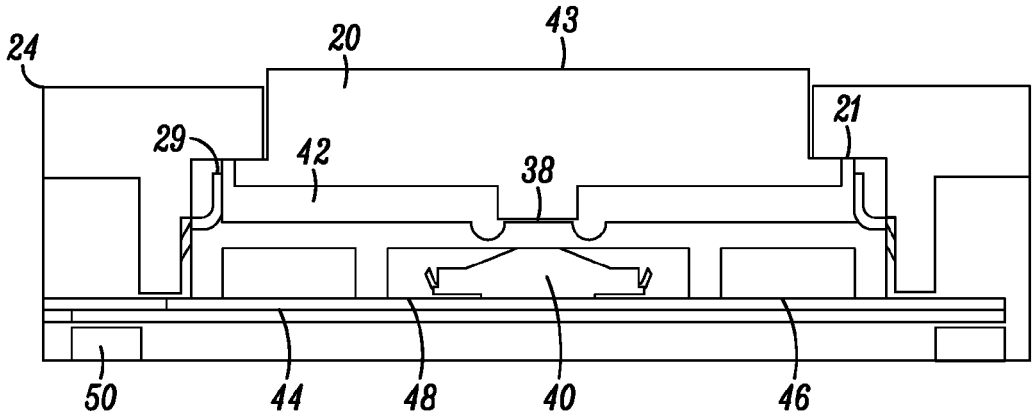
FIG. 2 is a cross-sectional view of a side key backloaded from inside the electronic device along with a side key flex assembly with stiffener that presses against the water sealing side key system.

As shown in FIG. 2, the side key can comprise a back loaded side key 20 which can be back loaded from inside the electronic device and retained in the housing by side flanges 42 that provide side flange potions. The moveable side key can have: a head 43 which provides a finger tip-engagable button, a plunger 38 for engaging and activating the switch 40, and an intermediate portion which can comprise side flange portions that extends between the button and the plunger. The side flange portions can have a maximum transverse, lateral or diametric span which is greater than the maximum transverse, lateral or diametric span of the head and smaller than the maximum transverse, lateral or diametric span of the plunger. A side key flex 44 with stiffener 46 provides a side key flex stiffener assembly 48 which can press against the seal assembly and can be retained by the housing ribs 50.

Figure 3:
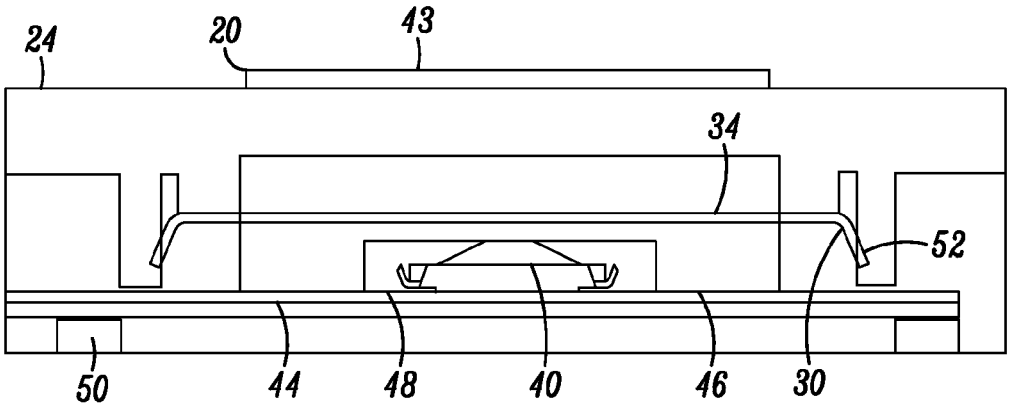
FIG. 3 is a cross-sectional view of the water sealing side key system with a switch.

As shown in FIG. 3, the seal assembly can be pressed into the housing until the sheet metal contacts the housing racetrack walls and compresses the silicon material. The sheet metal spring fingers 52 lock the seal assembly against the housing.

This side key system works with a switch, such as a flex mounted switch, dome or printed circuit board (PCB) mounted switch.

Figure 4:
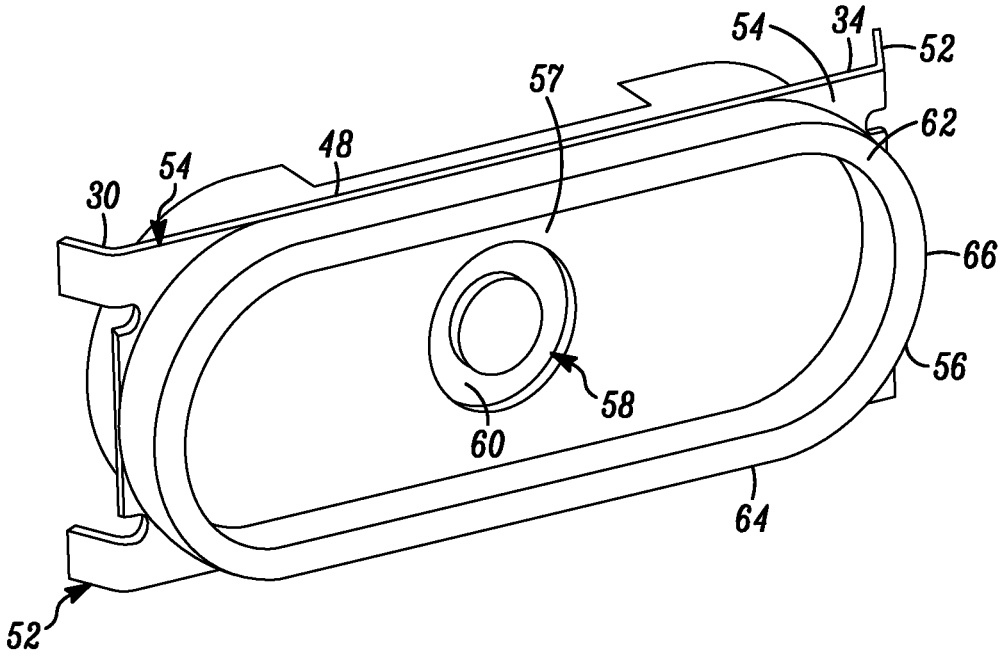
FIG. 4 is a perspective front view of the water sealing side key system.

FIG. 4 is a perspective view of the water sealing side key system and illustrating the sheet metal flat surfaces 54 against the housing walls and which determine the silicon compression. The outer front side 56 of the outer front water seal assembly 57 provides a front wall of the water sealing side key system can have a central recessed portion 58 with locally thinned silicon 60 for improved flexure and tactile feeling. The water seal assembly can have an oval rim 62 with elongated parallel sides 64 and curved C-shaped convex ends 66. The spring fingers can retain the seal assembly in the housing.

Figure 5:
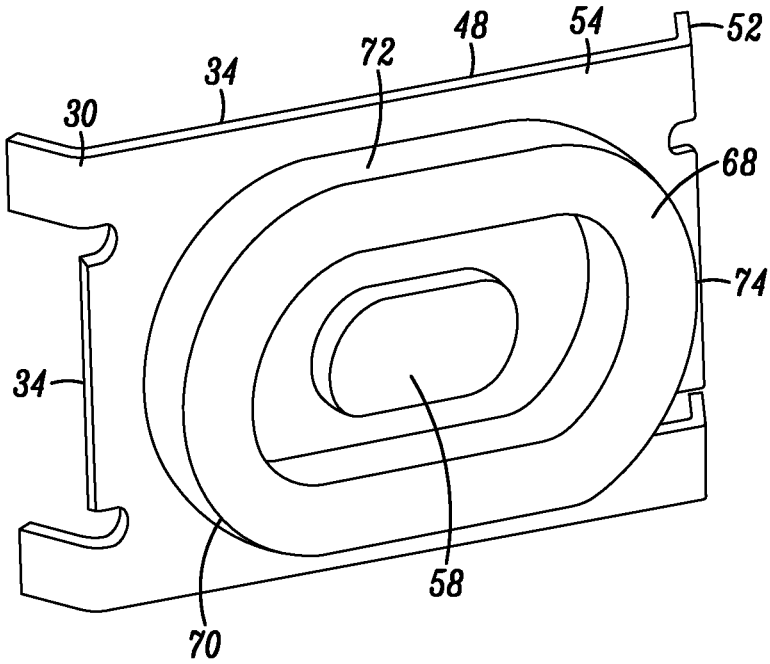
FIG. 5 is a perspective front view of another water sealing side key system for an electronic device in accordance with principle of the present invention.

FIG. 5 is a perspective view of a smaller water sealing side key system 68 and illustrating the sheet metal flat surfaces against the housing walls and which determine the silicon compression. The smaller water sealing side key system has an oval rim 70 with shorter smaller elongated parallel walls 72 and curved ends 74.

Figure 6:
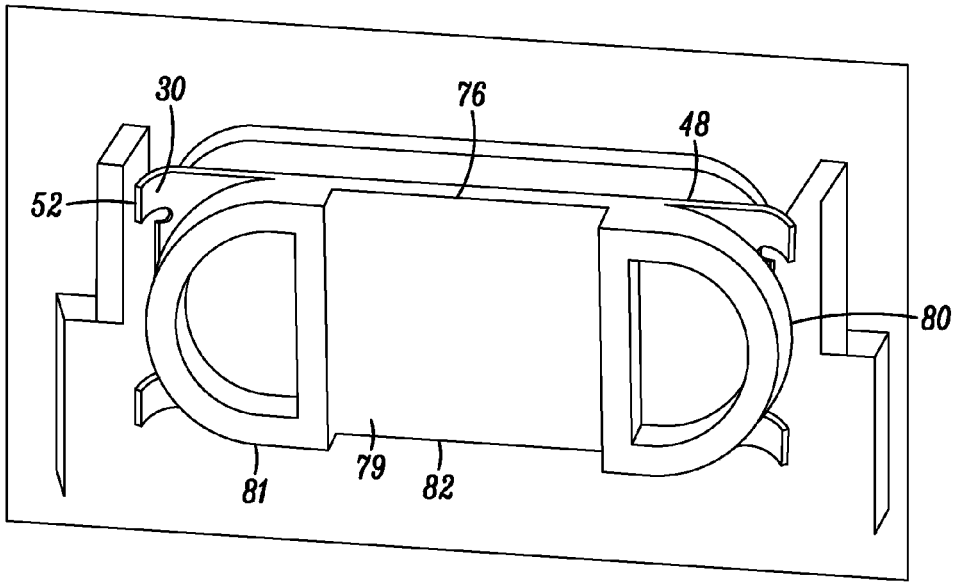
FIG. 6 is a back view of the water sealing side key system of FIG. 5 pressed into the housing.

FIG. 6 is a back view of the inner back side 76 of the water sealing side key system pressed into the housing.

Figure 7:
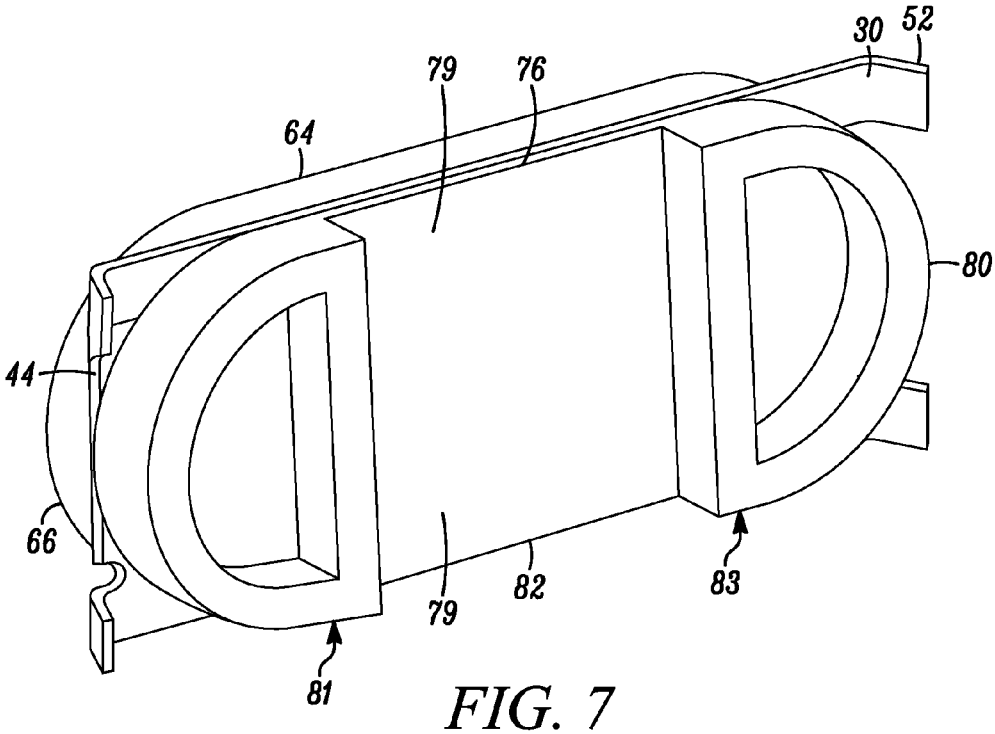
FIG. 7 is a perspective back view of the water sealing side key system of FIG. 5.
Figure 8:
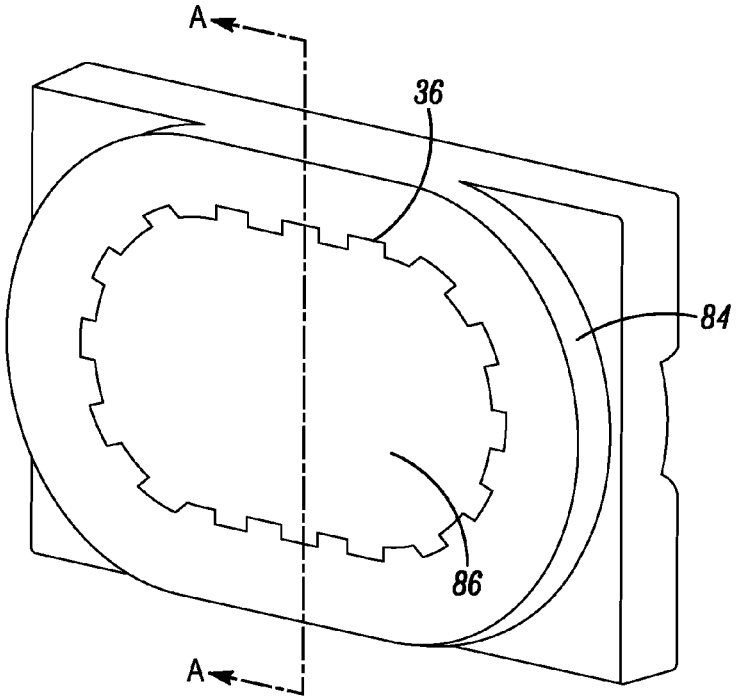
FIG. 8 is a perspective view of a molding of the water sealing side key system and housing.
Figure 9:
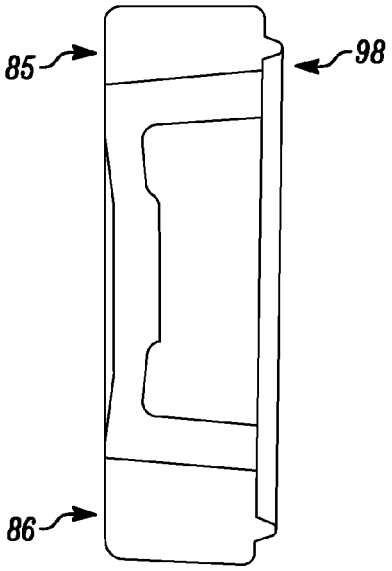
FIG. 9 is a cross-sectional view of the molding of the water sealing side key system and housing taken substantially along line A-A of FIG. 8.

FIG. 7 is a perspective back view of the water sealing side key system of FIG. 5. The back side of the inner back seal assembly 78 provides a rear wall 79 which can have D-shaped end rims 80-81 separated by a recessed intermediate central section 82. The D-shaped end rims provide rear seal walls 83 which can accommodate designed spacing between the side key plunger and the switch FIG. 8 is a perspective view of a molding of the water sealing side key system and housing with silicone over mold material 36. FIG. 9 is a cross-sectional view of the molding 84 of the water sealing side key system and housing taken substantially along line A-A of FIG. 8. The first shot 85 can comprise the outer portion of the water sealing side key system and can comprise polycarbonate (PC) with a spiked energy director 98. The second shot 86 can provide the inner portion of the water sealing side key system and can comprise silicone or thermoplastic polyurethane (TPU). The first and second shots are molded and hermetically sealed together. The seal can be attached and water sealed to the housing by connectors, such as by ultrasonic welding, glue or adhesive bonding.

Figure 10:
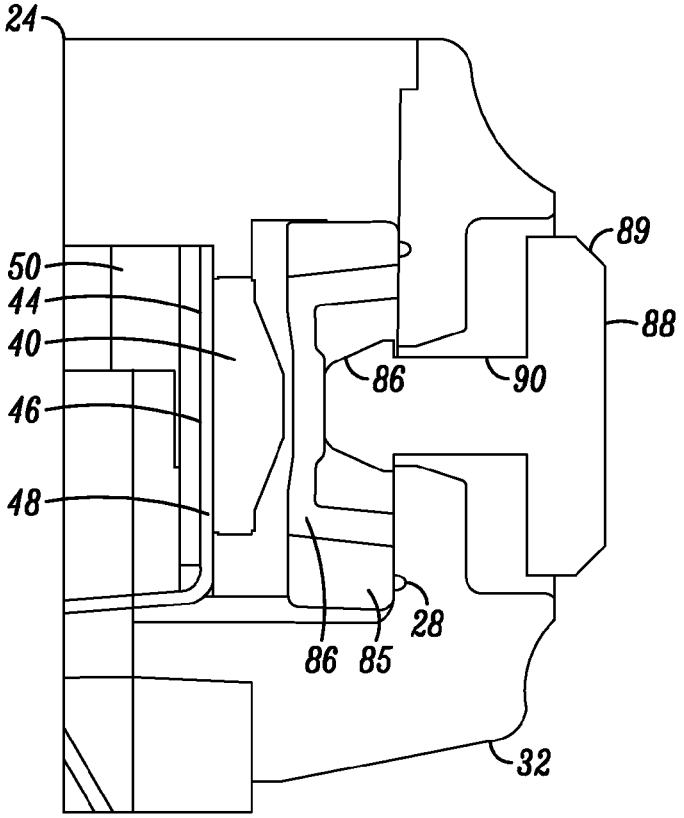
FIG. 10 is a cross-sectional view of a side key front loaded from outside the electronic device in accordance with principle of the present invention.

FIG. 10 is a cross-sectional view of a front loaded moveable side key 87 which can be front loaded from outside the electronic device and retained in the housing by the snap head feature of a frustoconical plunger 87 and an enlarged button head 88 which can provide a finger tip-engagable beveled button cap with a chamfer 89 providing beveling. The front loaded side key can have an elongated stem 90 which provides an intermediate portion and a shaft that extends between the head and the frustoconical plunger. The stem can have a maximum transverse, lateral or diametric span that is smaller than the maximum transverse, lateral or diametric span of the enlarged head, but smaller than the maximum transverse, lateral or diametric span of the frustoconical plunger.

For best results, the hermetically sealed molded inner and outer portions 85 and 86 (FIG. 10) of the water sealing side key system are water sealed to the sheet metal sidewall and/or housing 32 by one or more connectors, preferably by ultrasonic welds 99. Ultrasonic welding equipment can be readily customized to fit the exact specifications of the parts being welded. The parts can be sandwiched between a fixed shaped nest (anvil) and a sonotrode (horn) connected to a transducer, and a low-amplitude acoustic vibration is emitted. Common frequencies that can be used in ultrasonic welding of thermoplastics are 15 kHz, 20 kHz, 30 kHz, 35 kHz, 40 kHz and 70 kHz. When welding plastics, the interface of the parts has a spiked energy director 98 to concentrate the melting process and contact the other plastic or metal part. The ultrasonic energy melts the point contact between the parts, creating a joint. This process is a good alternative to glue, screws or snap-fit designs. It is particularly useful for mobile phones. Ultrasonic welding of thermoplastics causes local melting of the plastic due to absorption of vibration energy. The vibrations are introduced across the joint to be welded. In metals, ultrasonic welding occurs due to high-pressure dispersion of surface oxides and local motion of the materials. Although there is heating, it is not enough to melt the base materials. Vibrations are introduced along the joint being welded. Ultrasonic welding can be used for both hard and soft plastics. One difference between ultrasonic welding and traditional welding is the ability of ultrasonic welding to join dissimilar materials. The benefits or ultrasonic welding are that it is much faster than conventional adhesives or solvents. The drying time is very quick, and the pieces do not need to remain in a jig for long periods of time waiting for the joint to dry or cure. The welding can easily be automated, making clean and precise joints. The site of the weld is very clean and rarely requires and touch-up work.

Figure 11:
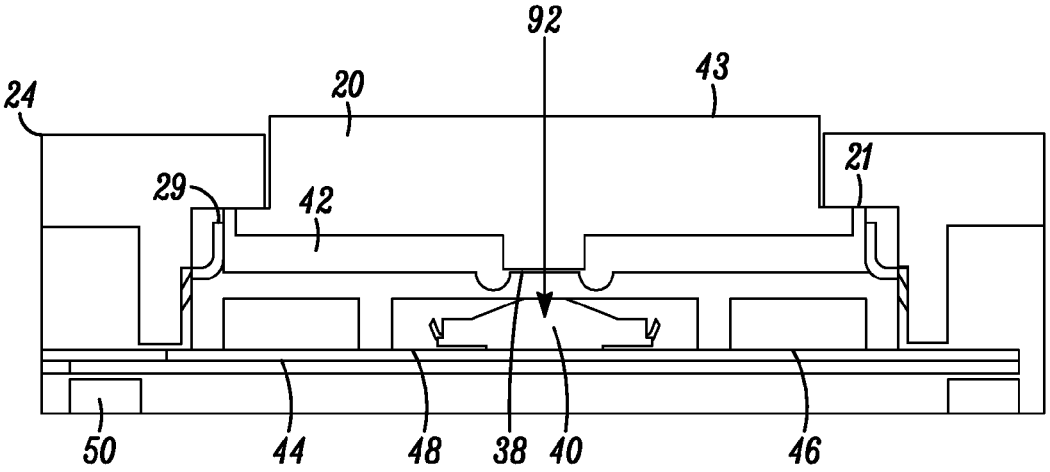
FIG. 11 is a cross-sectional view of the water sealing side key system similar to FIG. 2 illustrating the side key activation direction of force toward the switch.

FIG. 11 is a cross-sectional view of the water sealing side key system which is similar to FIG. 2 and illustrates the direction of the side key activation force. The side key activation force 92 is transmitted directly to the switch 40, improving tactile feel for the user. The overall side key system provides both a compressive and perimeter gasket seal but also allows the switch position to be tightly controlled within the electronic device. The silicone adjacent the L-shaped metal frame portion can be compressed and expand laterally and longitudinally to form an enhanced seal.

The mobile electronic device can be a radiotelephone, a cellular (cell) phone, a mobile phone, smart phone, flip phone, slider phone, android phone, tablet phone, camera phone, clam shell device, portable networking device, qwerty flip device, wireless device, portable gaming device, mobile communications device, personal digital assistant (PDA), wireless e-mail device, a two way pager, internet communication device, android tablet, ipod, ipad, blackberry, tablet device, laptop computer, netbook, personal computer, hand held electronic device, or combinations of any of the preceding. Desirably, the mobile electronic device is of a compact size for readily fitting in a shirt pocket, pants pocket, suit pocket, and/or purse.

In the preferred form, the electronic device comprises: a switch, a moveable key, a housing and a composite seal assembly. The moveable side key can have: a head which provides a finger tip-engagable button, a plunger for engaging and activating the switch, and an intermediate portion which extends between the button and the plunger. The housing can have ribs and substantially oval walls which can provide a racetrack.

The composite seal assembly can comprise a sheet metal sidewall and an elastomeric perimeter gasket seal, which can be formed of a silicone polymer, for compressively and circumferentially sealing the moveable side key so that the side key is substantially impervious and impermeable to water and many other liquids. The elastomeric perimeter gasket seal can include an elastomeric over mold material formed of a silicone polymer. The sheet metal sidewall can have substantially flat planar portions which provide flats and can have metal spring fingers. The seal can have a compressive face and a peripheral seal portion for hydrodynamically sealing and engaging the side key while the side key is traveling on the sheet metal sidewall to accommodate non-binding sliding movement of the side key on the elastomeric over mold material. The seal assembly can be pressed into the housing until the sheet metal flats contacts the racetrack of the oval walls and compress the elastomeric over mold material and the elastomeric seal material to the prescribed and designed compression. The sheet metal spring fingers can lock the seal assembly against the housing and substantially prevent it from backing out of the housing.

The seal assembly can have a rear wall for providing and controlling tolerance spacing between the side key plunger and the switch for an enhanced tactile feel. The water seal assembly can comprises a front wall having a central recessed portion with locally thinned silicon material for improved flexure and tactile feeling. The front wall can have an oval rim with elongated substantially parallel sides and curved convex ends. The water seal assembly can have a rear wall comprising D-shaped end rims separated by a recessed intermediate central section. The D-shaped end rims can provides a rear seal wall for accommodating predetermined designed spacing between the plunger and the switch.

A side key flex assembly with a stiffener can be positioned above the switch for pressing against the seal assembly. The side key flex assembly can be retained by the ribs of the housing. The switch can be a flex mounted switch, a dome switch or a printed circuit board (PCB) mounted switch.

The side key can comprise a back loaded side key which is back loaded from inside the electronic device and retained in the housing by side flanges. The intermediate portion comprises side flange portions retained in the housing. The side flange portions have a transverse, lateral or diametric span which is greater than the head and smaller than said plunger.

The side key can further comprise a front loaded side key which is front loaded from outside the electronic device. The front loaded side can have an enlarged head, a frustoconical plunger, and an intermediate portion which comprises a stem. The frustoconical plunger and enlarged head can cooperate with each other to provide a snap head feature for retaining the front loaded side key in the housing. The stem can have a maximum transverse, lateral or diametric span that is smaller than the maximum transverse, lateral or diametric span of the enlarged head, but smaller than the maximum transverse, lateral or diametric span of the frustoconical plunger.

Among the many advantages of the water sealing side key system for an electronic device are:

1. Superior capability.
2. Superb performance.
3. Enhanced operation.
4. Excellent sealing and waterproofing of sides keys.
5. Outstanding ability to function with moisture.
6. Better tactile feeling and touch control.
7. Comfortable.
8. Reliable.
9. User friendly.
10. Easy to operate.
11. Durable
12. Economical.
13. Attractive.
14. Efficient.
15. Effective.

Although embodiments of the invention have been shown and described, it is to be understood that various modifications, substitutions, and different materials, rearrangements of parts, components, and/or process (method) steps, as well as other uses of the water sealing side key system and the electronic devices can be made by those skilled in the art without departing from the novel spirit and scope of this invention.

What is claimed is:

1. A water sealing side key system of an electronic device, comprising:

an electronic device comprising a switch;

a moveable side key having a head providing a button, a plunger for engaging and activating said switch, and an intermediate portion extending between said button and plunger;

a housing having ribs and substantially oval walls providing a racetrack;

a composite seal assembly comprising a metal sidewall and elastomeric seal for compressively and circumferentially sealing said moveable side key so that said side key is substantially impermeable to water, said elastomeric seal including elastomeric over mold material, said metal sidewall having substantially flat planar portions providing flats and metal spring fingers;

said seal having a compressive face and peripheral seal portion for hydrodynamically sealing and engaging said side key while said side key is traveling on the metal sidewall to accommodate non-binding sliding movement of said side key on said elastomeric over mold material;

said seal assembly being pressed into said housing until said metal flats contacts said racetrack of said oval walls and compresses said elastomeric over mold material and said elastomeric seal material to a prescribed compression;

said metal spring fingers locking said seal assembly against said housing and substantially prevent said seal assembly from backing out of said housing;

a side key flex assembly with a stiffener positioned above said switch for pressing against said seal assembly, said side key flex assembly being retained by said ribs of said housing; and said seal assembly having a rear wall for providing and controlling tolerance spacing between said side key plunger and said switch for enhanced tactile feel.

2. A water sealing side key system of an electronic device in accordance with claim 1 wherein said switch is selected from the group consisting of: a flex mounted switch, a dome switch and a printed circuit board (PCB) mounted switch.

3. A water sealing side key system of an electronic device in accordance with claim 1 wherein:

said side key comprises a back loaded side key;

said intermediate portion comprises side flange portions retained in said housing; and said side flange portions have a diametric span greater than said head and smaller than said plunger.

4. A water sealing side key system of an electronic device in accordance with claim 1 wherein said:

side key is a front loaded side key;

said intermediate portion comprises a stem;

said head comprises an enlarged head;

said plunger comprises a frustoconical plunger;

said frustoconical plunger and said enlarged head cooperate with each other to provide a snap head feature for retaining said front loaded side key in said housing;

said stem has a maximum diametric span smaller than said enlarged head;

said stem has a maximum diametric span smaller than said frustoconical plunger; and said composite seal assembly comprises a connector for water sealing said elastomeric seal to said sidewall, said connector is selected from a group consisting of an ultrasonic weld, glue and adhesive.

5. A water sealing side key system of an electronic device in accordance with claim 1 wherein said electronic device comprises a mobile electronic device selected from the group consisting of: a radiotelephone, a cellular (cell) phone, a mobile phone, smart phone, flip phone, slider phone, android phone, tablet phone, camera phone, clamshell device, portable networking device, qwerty flip device, wireless device, portable gaming device, mobile communications device, personal digital assistant (PDA), wireless e-mail device, a two way pager, internet communication device, android tablet, ipod, ipad, blackberry, tablet device, laptop computer, netbook, personal computer, hand held electronic device, and combinations of any of the preceding.

6. A water sealing side key system of an electronic device in accordance with claim 1 wherein:

said rear wall comprises D-shaped end rims separated by a recessed intermediate central section; and said D-shaped end rims provides a rear seal wall for accommodating designed spacing between the plunger and said switch.

7. A water sealing side key system of an electronic device in accordance with claim 1 wherein:

said water seal assembly comprises a front wall having a central recessed portion with locally thinned elastomeric material for improved flexure and tactile feeling; and said front wall having an oval rim with elongated substantially parallel sides and curved ends.

8. A water sealing side key system of an electronic device, comprising:

a mobile electronic device selected from the group consisting of a radiotelephone, a cellular (cell) phone, a mobile phone, smart phone, flip phone, slider phone, android phone, tablet phone, camera phone, clamshell device, portable networking device, qwerty flip device, wireless device, mobile communications device, personal digital assistant (PDA), wireless e-mail device, a two way pager, internet communication device, android tablet, ipod, ipad, blackberry, tablet device, hand held electronic device, and combinations of any of the preceding;

said electronic device comprising a switch;

a moveable side key having a head providing a finger tip-engagable button, a plunger for engaging and activating said switch, and an intermediate portion extending between the button and plunger;

a housing having ribs and substantially oval walls providing a racetrack;

a composite seal assembly comprising a sheet metal sidewall and elastomeric perimeter gasket seal comprising a silicone polymer for compressively and circumferentially sealing said moveable side key so that said side key is substantially impervious to water, said elastomeric perimeter gasket seal including elastomeric over mold material comprising a silicone polymer, said sheet metal sidewall having metal fingers and substantially flat planar portions providing flats;

said seal having a compressive face and peripheral seal portion for hydrodynamically sealing and engaging said side key while said side key is traveling on the sheet metal sidewall to accommodate non-binding sliding movement of said side key on said elastomeric over mold material;

said seal assembly being pressed into said housing until said sheet metal flats contacts said racetrack of said oval walls and compress said elastomeric over mold material and said elastomeric seal material to a prescribed compression;

said sheet metal spring fingers locking said seal assembly against said housing and substantially preventing said seal assembly from backing out of said housing; and a side key flex assembly with a stiffener positioned above said switch for pressing against said seal assembly, said side key flex assembly being retained by said ribs of said housing; and said seal assembly having a rear wall for providing and controlling tolerance spacing between said side key plunger and the switch for enhanced tactile feel.

9. A water sealing side key system of an electronic device in accordance with claim 8 wherein said switch is selected from the group consisting of: a flex mounted switch, a dome switch and a printed circuit board (PCB) mounted switch.

10. A water sealing side key system of an electronic device in accordance with claim 8 wherein:

said side key comprises a back loaded side key;

said intermediate portion comprises side flange portions retained in said housing; and said side flange portions have a transverse span greater than said head and smaller than said plunger.

11. A water sealing side key system of an electronic device in accordance with claim 8 wherein said:

side key is a front loaded side key;

said intermediate portion comprises a stem;

said head comprises an enlarged head;

said plunger comprises a frustoconical plunger;

said frustoconical plunger and said enlarged head cooperating with each other to provide a snap head feature for retaining said front loaded side key in said housing;

said stem has a maximum transverse span smaller than said enlarged head;

said stem has a maximum transverse span smaller than said frustoconical plunger.

12. A water sealing side key system of an electronic device in accordance with claim 8 wherein said mobile electronic device is selected from the group consisting of: a radiotelephone, a cellular (cell) phone, a mobile phone, smart phone, flip phone, slider phone, android phone, tablet phone, camera phone, and combinations of any of the preceding.

13. A water sealing side key system of an electronic device in accordance with claim 8 wherein:

said water seal assembly comprises a front wall having a central recessed portion with locally thinned silicon material for improved flexure and tactile feeling; and said front wall has an oval rim with elongated substantially parallel sides and curved convex ends.

14. A water sealing side key system of an electronic device in accordance with claim 13 wherein:

said rear wall comprises D-shaped end rims separated by a recessed intermediate central section; and said D-shaped end rims provides a rear seal wall for accommodating predetermined spacing between said plunger and said switch.

15. A water sealing side key system of an electronic device in accordance with claim 11 wherein:

said elastomeric perimeter gasket seal comprises an inner portion hermetically sealed and molded to an outer portion;

said outer portion having a spiked energy director; and said composite seal assembly having ultrasonic welds for water sealing and securely connecting said elastomeric perimeter gasket seal and said spiked energy director to said sidewall.

* * * * *